US009889978B2

(12) United States Patent
Wochele

(10) Patent No.: US 9,889,978 B2
(45) Date of Patent: Feb. 13, 2018

(54) PROTECTIVE CAP FOR A DISPENSER AND DISPENSER FOR DISCHARGING PHARMACEUTICAL AND/OR COSMETIC LIQUIDS

(71) Applicant: APTAR RADOLFZELL GMBH, Radolfzell (DE)

(72) Inventor: Matthias Wochele, Friolzheim (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 15/103,644

(22) PCT Filed: Dec. 16, 2014

(86) PCT No.: PCT/EP2014/078044
§ 371 (c)(1),
(2) Date: Jun. 10, 2016

(87) PCT Pub. No.: WO2015/091536
PCT Pub. Date: Jun. 25, 2015

(65) Prior Publication Data

US 2016/0311589 A1 Oct. 27, 2016

(30) Foreign Application Priority Data

Dec. 17, 2013 (DE) ..... 10 2013 226 250

(51) Int. Cl.
*B67B 1/00* (2006.01)
*B65D 51/16* (2006.01)
(Continued)

(52) U.S. Cl.
CPC ..... *B65D 51/1616* (2013.01); *B65D 41/32* (2013.01); *B65D 41/48* (2013.01);
(Continued)

(58) Field of Classification Search
CPC ..... B65D 51/1611; B65D 51/1622; B65D 35/36; B65D 51/1616; B65D 51/18;
(Continued)

(56) References Cited

U.S. PATENT DOCUMENTS 1,481,035 A 1/1924 Stattmann
3,163,311 A 12/1964 Stolk
(Continued)

FOREIGN PATENT DOCUMENTS

CN 1172759 A 2/1998
DE 895 859 11/1953
(Continued)

OTHER PUBLICATIONS

International Search Report issued in Application No. PCT/EP2014/078044 with English translation, dated Feb. 24, 2015 (9 pages).
(Continued)

*Primary Examiner* — Lien Ngo
(74) *Attorney, Agent, or Firm* — Flynn, Thiel, Boutell & Tanis, P.C.

(57) ABSTRACT

A protective cap for a dispenser for discharging pharmaceutical and/or cosmetic liquids, wherein the dispenser has a liquid reservoir and an outlet opening through which the liquid can be dispensed into a surrounding atmosphere, and wherein the protective cap has at least one ventilation opening to allow communication between an interior and external surroundings. An irreversibly removable sealing element which covers the at least one ventilation opening is arranged on the protective cap, which sealing element closes the at least one ventilation opening in an airtight and germproof manner before a first use.

10 Claims, 4 Drawing Sheets

(51) Int. Cl.

| | |
|---|---|
| ***B65D 41/48*** | (2006.01) |
| ***B65D 47/20*** | (2006.01) |
| ***B65D 51/18*** | (2006.01) |
| ***B65D 41/32*** | (2006.01) |

(52) U.S. Cl.
CPC ..... *B65D 47/2068* (2013.01); *B65D 51/16* (2013.01); *B65D 51/18* (2013.01); *B65D 2205/025* (2013.01); *B65D 2251/0015* (2013.01); *B65D 2251/0087* (2013.01)

(58) Field of Classification Search
CPC ..... B65D 51/16; B65D 41/48; B65D 41/32; B65D 2205/025; B65D 2251/0015; B65D 2251/0087; B05B 11/00; B05B 11/0032
USPC ..... 222/153.07, 153.1, 562, 541.1–541.9; 220/271, 265, 266, 371, 377, 367.1; 215/901, 902, 326, 247–257, 250–257
See application file for complete search history.

(56) References Cited

U.S. PATENT DOCUMENTS

| | | | | |
|---|---|---|---|---|
| 3,255,928 | A * | 6/1966 | Foster | A61J 1/03 215/237 |
| 4,817,815 | A | 4/1989 | Stahlecker | |
| 5,016,770 | A | 5/1991 | Rizzardi | |
| 5,094,357 | A | 3/1992 | McKinney | |
| 5,904,259 | A | 5/1999 | Hidding et al. | |
| 5,954,214 | A | 9/1999 | Guezennec et al. | |
| 6,540,726 | B1 | 4/2003 | Follman et al. | |
| 8,057,118 | B2 * | 11/2011 | Yuhas | A45D 34/04 215/254 |
| 8,292,129 | B2 * | 10/2012 | Stadelhofer | B05B 11/0027 222/182 |
| 2007/0125394 | A1 | 6/2007 | Sieredzinski | |
| 2009/0110782 | A1 | 4/2009 | Mellor | |
| 2010/0111772 | A1 | 5/2010 | Hartofelis | |
| 2014/0336596 | A1 | 11/2014 | Wochele | |
| 2015/0043958 | A1 * | 2/2015 | Painchaud | B05B 11/00 401/262 |

FOREIGN PATENT DOCUMENTS

| | | | |
|---|---|---|---|
| DE | 37 14 949 | A1 | 11/1988 |
| DE | 200 11 835 | U1 | 8/2001 |
| DE | 101 20 827 | A1 | 11/2001 |
| DE | 10 2011 086 755 | A1 | 5/2013 |
| EP | 0 339 336 | A1 | 11/1989 |
| EP | 0 816 283 | A1 | 1/1998 |
| EP | 0 881 159 | A1 | 12/1998 |
| EP | 1 792 842 | A1 | 6/2007 |
| EP | 1 795 842 | A1 | 6/2007 |
| WO | WO 2012/169883 | A1 | 12/2012 |
| WO | WO 2013/140069 | A1 | 9/2013 |

OTHER PUBLICATIONS

Written Opinion of International Searching Authority issued in Application No. PCT/EP2014/078044 dated Feb. 24, 2015 (8 pages).
Chinese Office Action with English translation issued in Application No. 201480069358.8 dated Dec. 26, 2016 (12 pages).

* cited by examiner

PROTECTIVE CAP FOR A DISPENSER AND DISPENSER FOR DISCHARGING PHARMACEUTICAL AND/OR COSMETIC LIQUIDS

APPLICATION AREA AND PRIOR ART

The invention relates to a protective cap for a dispenser and to a dispenser for discharging pharmaceutical and/or cosmetic liquids. Such a dispenser comprises a liquid reservoir and an exit opening, through which the liquid can be discharged into a surrounding atmosphere.

A liquid stored in the liquid reservoir is fed in the direction of the exit opening in order to be discharged, it being possible for this to take place by way of a large number of different mechanisms. For example, the liquid reservoir may be designed in the form of a squeeze bottle, of which the contents can be subjected to pressure as a result of the walls being deformed. It is also possible to use a separate pumping device.

Dispensers of the type in question are known from the prior art, for example from DE 10 2011 086 755 A1. The dispenser comprises an outlet channel and an outlet valve, which is arranged in the outlet channel and opens in a pressure-dependent manner or is manually actuable, wherein the outlet valve, in the closed state, closes the outlet channel. The outlet valve subdivides the outlet channel here into a first part and a second part, wherein the second part, adjacent to the exit opening, extends in the direction of the liquid reservoir. In other configurations, the second part corresponds to a droplet-forming surface at the exit opening.

As a result of the outlet valve, it is always the case that, following closure of the same, it is not possible for any liquid which has passed into a portion of the outlet channel on an outlet-valve side directed away from the liquid reservoir, or which has remained in the surroundings of the exit opening outside the outlet channel, to be sucked back into the dispenser. This therefore prevents the contents of the liquid reservoir from possibly being contaminated by liquid residues which have been sucked back. The residual liquid therefore remains in a region which is accessible from the outside. Upon contact with the atmosphere, the residual liquid dries up quickly.

In order also to make it possible for the residual liquid to dry up quickly when a protective cap is placed in position on the dispenser, DE 10 2011 086 755 A1 discloses providing the protective cap of the dispenser with ventilation openings which create a permanent connection between the region in which residual liquid can remain and exterior surroundings. However, it is possible for the ventilation openings, for their part, to cause contamination again.

In order to avoid contamination, DE 10 2011 086 755 A1 makes provision for surfaces of the outlet channel downstream of the outlet valve, as seen in the discharging direction, and/or an outer surface of a housing which surrounds the exit opening to be of antibacterial design, wherein the antibacterial design is restricted exclusively to these surfaces.

PROBLEM AND SOLUTION

It is an object of the invention to make available a protective cap which is intended for a dispenser, allows rapid drying and which alleviates the problem of microorganisms penetrating into the protective cap. A further object of the invention is that of making available a dispenser with a corresponding protective cap.

A first aspect of the invention provides for a protective cap for a dispenser for discharging pharmaceutical and/or cosmetic liquids, wherein the dispenser has a liquid reservoir and an exit opening, through which the liquid can be discharged into a surrounding atmosphere, and wherein the protective cap has at least one ventilation opening in order for an interior to communicate with exterior surroundings, and the protective cap has arranged on it an irreversibly removable sealing element, which covers the at least one ventilation opening and by means of which the at least one ventilation opening is closed in an air-tight and germ-proof manner prior to the dispenser being used for the first time.

A second aspect of the invention provides for a discharging device comprising a dispenser for discharging pharmaceutical and/or cosmetic liquids, having a liquid reservoir and having an exit opening, through which the liquid can be discharged into a surrounding atmosphere, and having a protective cap, which has at least one ventilation opening in order for an interior to communicate with exterior surroundings, wherein the protective cap has arranged on it an irreversibly removable sealing element, which covers the at least one ventilation opening and by means of which the at least one ventilation opening is closed in an air-tight and germ-proof manner prior to the dispenser being used for the first time.

The sealing element prevents germs from being introduced into an interior of the protective cap via the at least one ventilation opening prior to the dispenser being used for the first time, without it being necessary to put special measures in place for storage, transportation, etc. In other words, the sealing element prevents germs from being deposited on the dispenser and in the interior of the protective cap over the course of time, during storage, transportation, etc., even prior to the dispenser being used for the first time. Before or after the dispenser is used for the first time, the sealing element is removed so that, during subsequent usage, the residual liquid can dry up rapidly. On account of the dispenser being used for only a short period of time, any possible introduction of germs following initial use is not usually critical.

Germs within the context of the present invention are to be understood as being all microbial pathogens, in particular bacteria and viruses. A germ-proof and air-tight closure within the context of the application denotes a sealing arrangement in which the leakage rate is less than or equal to $10^{-6}$ mbar l/s when the dispenser is stored under normal or standard conditions. The germ proofing is tested, for example, in accordance with DIN 58953. In other configurations, the sealing element is designed so as to satisfy the measured stipulated by standards DIN EN ISO 11607 and/or DIN EN ISO 11868.

The dispenser is suitable, in particular, for unpreserved ophthalmic preparations. In advantageous configurations, the dispenser has an outlet channel, which connects the liquid reservoir to the exit opening, and an outlet valve, which opens in a pressure-dependent manner or is manually actuable, wherein the outlet valve is arranged in the outlet channel and, in a closed state, closes the outlet channel. The outlet valve here prevents germs from penetrating into the liquid reservoir. The outlet valve is preferably an outlet valve which opens in a pressure-dependent manner and is opened by the liquid in the liquid reservoir, or an amount removed therefrom, being subjected to pressure and closes automatically again as soon as the corresponding positive pressure in relation to the surroundings is no longer present. It is also possible in principle here, however, to use other types of valves. Provision may thus be made, for example, for the liquid in the liquid reservoir to be subjected permanently to pressure and for the dispenser to be handled by way of a handle which is actuated manually to open the outlet valve. The outlet valve prevents discharged liquid from being sucked back into the liquid reservoir. The at least one ventilation opening on the protective cap causes said residual liquid to dry up rapidly.

In advantageous configurations, provision is made for the protective cap to comprise a cylindrical portion and a cover portion connected thereto, wherein the at least one ventilation opening is provided on the cylindrical portion and/or on the cover portion. In one configuration, the cylindrical portion has, on its inner wall, a latching geometry for latching to the dispenser and/or a clamping region which comes into contact with the dispenser. If the at least one ventilation opening is provided on the cylindrical portion, the region of the ventilation opening preferably does not coincide with the region of the latching geometry or the clamping region. The ventilation openings are preferably arranged in a region which, when the protective cap is in use, is arranged essentially in the region of the exit opening of the dispenser.

In one configuration, provision is made for the sealing element to be designed in the form of a pull-off, air-tight and germ-proof adhesive label. An adhesive label or sticky label within the context of the application denotes an element which has one or more layers and a non-adhesive upper side and an adhesive underside. In order to avoid contamination, the adhesive label, in advantageous configurations, can be pulled off cleanly. An adhesive for the adhesive label can be selected appropriately by a person skilled in the art, it being necessary to adhere to legal requirements on account of a liquid or the like being stored in the dispenser. An adhesive is preferably selected such that it is not possible for the adhesive label to re-adhere. Within the context of the application, however, an adhesive label which, contrary to normal practice, is re-fitted to cover the ventilation opening is denoted as being an irreversibly removable sealing element. In one configuration, an adhesive-label region which is arranged directly in the region of the exit opening when adhesion takes place has no adhesive.

The adhesive label is arranged on an inner side and/or an outer side of the protective cap, in the region of the at least one ventilation opening. In one configuration, the adhesive label extends over a region which surrounds the ventilation opening(s). In other configurations, the adhesive label extends over further regions. The adhesive label preferably exhibits text with instructions for use or the like. The adhesive label is preferably of sufficiently large dimensions for the text to be easily readable.

In one configuration, the adhesive label is connected to a tamperproof seal, so that the adhesive label is pulled off when the tamperproof seal is removed. As an alternative, or in addition, the adhesive label, in advantageous configurations, has a tear-open lug, by means of which a user grips the adhesive label in order to pull it off.

In another configuration, the sealing element is designed in the form of an air-tight and germ-proof film wrapper. The film wrapper here, in one configuration, covers merely the protective cap. The film wrapper can thus be fitted on the protective cap prior to the protective cap being latched on to the dispenser. In other configurations, the film wrapper covers the protective cap and the dispenser. The film wrapper, in one configuration, is designed in the form of a band which is wrapped around the protective cap or around the protective cap and the dispenser.

In advantageous configurations, the film wrapper is designed in the form of a wraparound film label which is closed on one side or is in the form of a sleeve. A wraparound film label within the context of the application denotes a tubular film into which the protective cap, or the dispenser with the protective cap, is introduced. Following introduction thereof, in advantageous configurations, shrink-fitting takes place.

As an alternative, or in addition, to shrink-fitting, the film wrapper, in advantageous configurations, is welded to the protective cap. The weld seam ensures air tightness and germ proofing. A weld seam here is arranged separately from a ventilation opening. This means that any residues which may possibly remain on the protective cap once the film wrapper has been torn off do not present a hazard.

In yet another configuration, the sealing element is designed in the form of a pull-off lug which is injection molded on the protective cap. The pull-off lug here can be produced along with the protective cap in the form of an integral constituent part of the same. It is thus possible to dispense with additional assembly steps or other production steps. In one configuration, the pull-off lug is coupled to a tamperproof seal, and this results in particularly straightforward handling for a user.

Following removal of the sealing element, the at least one ventilation opening provides for rapid drying. In order to alleviate the problem of germs being introduced via said ventilation opening, one configuration provides an antibacterial configuration of the surfaces, as is known from DE 10 2011 086 755 A1. Reference is made in full here to the contents of DE 10 2011 086 755 A1.

As an alternative, or in addition, an inner side of the protective cap has provided on it, in the region of the at least one ventilation opening, an absorber element, in particular an absorber element with filter properties, such as a microfiltration membrane or an ultrafiltration membrane. The absorber element assists in drying the dispenser by virtue of absorbing and distributing the residual droplet. In one configuration, the absorber element additionally has filter properties, in particular a microfiltration membrane or an ultrafiltration membrane is provided. This reduces the introduction of germs via the ventilation openings once the sealing element has been removed. A microfiltration membrane within the context of the application denotes a microporous membrane which has an average pore diameter or a cutoff of approximately 0.1 μm to approximately 0.3 μm, preferably approximately 0.2 μm. Bacteria have a size of approximately 0.2 to approximately 5 μm, and can therefore be filtered out efficiently by means of a microfiltration membrane. An ultrafiltration membrane within the context of the application denotes a microporous membrane which has an average pore diameter or a cutoff of approximately 10 nm. This means that viruses of a size of 15 nm can also be filtered out. The absorber element is configured, for example, in the form of a sponge-like element, woven fabric or membrane. In one configuration, the absorber element is made of a material from the group comprising polysulfone, polyethersulfone, cellulose, cellulose derivatives, polyvinylidene fluoride, polyamide, polyester and polyacrylonitrile and/or combinations thereof.

BRIEF DESCRIPTION OF THE DRAWINGS

Further advantages and aspects of the invention can be gathered not just from the claims, but also from the following description of preferred exemplary embodiments of the invention, which will be explained hereinbelow with reference to the figures. The drawings use like reference signs to denote the same or similar components. Features illustrated or described as part of an exemplary embodiment can likewise be used in a different exemplary embodiment in order to achieve a further embodiment of the invention. In the drawings:

DETAILED DESCRIPTION OF THE EXEMPLARY EMBODIMENTS

Figure 1:
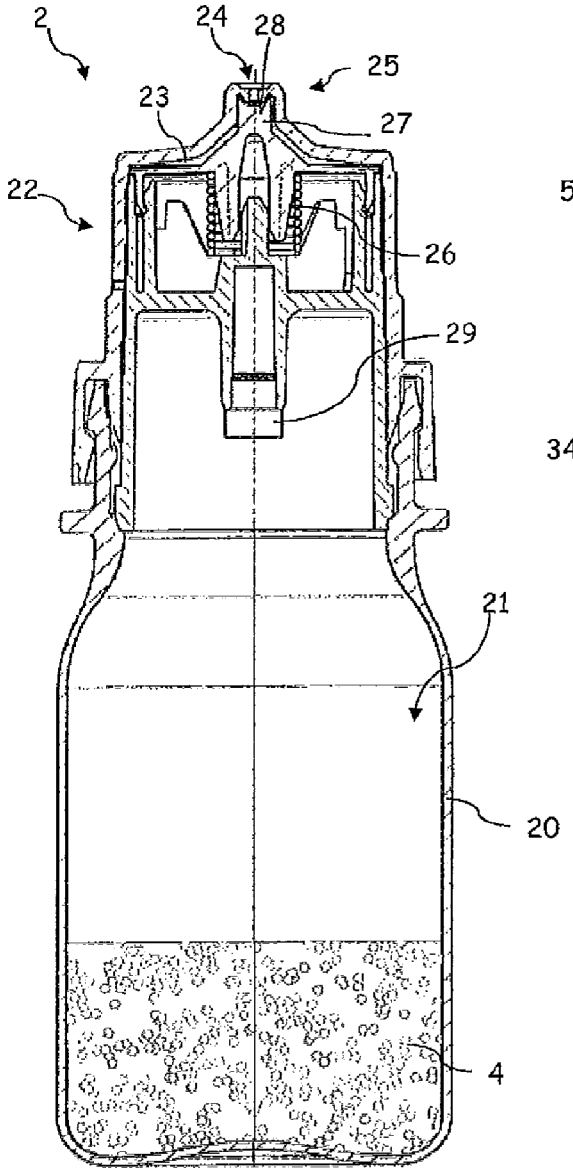
FIG. 1 shows a sectional illustration of a dispenser for discharging pharmaceutical and/or cosmetic liquids.

FIG. 1 shows, in the first instance, a dispenser 2 which is intended for discharging pharmaceutical and/or cosmetic liquids and is suitable, in particular, for unpreserved ophthalmic preparations.

Said dispenser 2 has a liquid reservoir 21, which is delimited by a container body 20. The liquid 4 is stored in the liquid reservoir 21. An outlet subassembly 22 has been placed in position, and fastened by means of a latching connection, on the container body 20. Said outlet subassembly 22 serves for directing liquid from the liquid reservoir 21 to an exit opening 24 through an outlet channel 23. The exit opening 24 illustrated is configured in the form of a droplet-forming surface and widens conically in the discharging direction.

On account of the section plane in FIG. 1, the latter illustrates merely a final part of the outlet channel 23. The outlet channel 23 has arranged in it an outlet valve 25 which, in a closed state, closes the outlet channel 23, and therefore liquid located downstream of the outlet valve 25, as seen in the discharging direction, cannot pass back into the liquid reservoir 21. The outlet valve 25 illustrated comprises a valve body 27, which can be adjusted counter to the force of a restoring spring 26 and interacts with a valve seat 28 formed on a housing wall. Air flows into the liquid reservoir 21, for pressure-equalization purposes, via a filter element 29. In advantageous configurations, the filter element 29 comprises a liquid filter, which is oriented in the direction of the liquid reservoir 21, and a bacteria filter, which is oriented away from the liquid reservoir 21 and has a cutoff of approximately 0.2 μm, so that bacteria of a size of approximately 0.2 to approximately 5 μm are reliably held back by the bacteria filter.

The dispenser 2 illustrated is configured in the form of a so-called squeeze bottle. Said dispenser 2 is used by being placed upside down with the exit opening 24 oriented downward. Thereafter, walls of the container body 20 are pressed together in order for the liquid 4 in the liquid reservoir 21 to be subjected to pressure. This pressure causes the outlet valve 25 to open. More specifically, as soon as the liquid pressure in a part of the outlet channel 23 upstream of the outlet valve 25 is sufficiently high, the valve body 27 shifts counter to the force of the restoring spring 26 as a result of said pressure and frees the path for the liquid in the direction of the exit opening 24.

Following a discharging operation, the outlet valve 25 is closed again. It is usual here for a residue of the liquid, the so-called residual droplet, to remain at the exit opening 24, configured in the form of the droplet-forming surface, and in a part of the outlet channel 23 assigned to the exit opening 24 and located downstream of the outlet valve 25 as seen in the discharging direction. The outlet valve 25, which opens in a pressure-dependent manner, precludes any possibility of the liquid flowing back into the liquid reservoir 12.

Without a protective cap being placed in position, the residual droplets can dry up rapidly. In order to make it possible for rapid drying also to take place when the protective cap has been placed in position, protective caps of the type in question have at least one ventilation opening.

Figure 2:
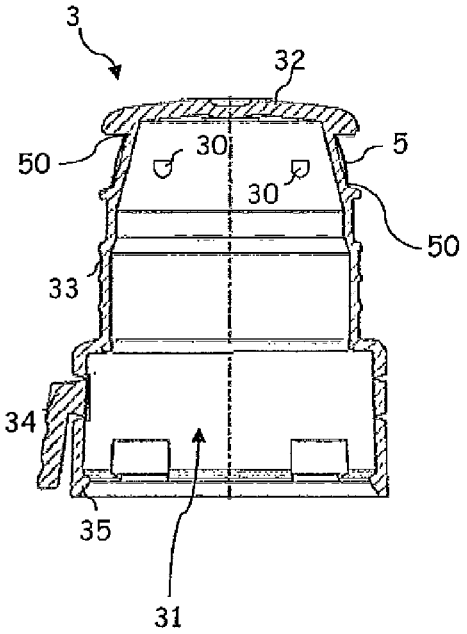
FIG. 2 shows a first exemplary embodiment of a protective cap for the dispenser according to FIG. 1.
Figure 3:
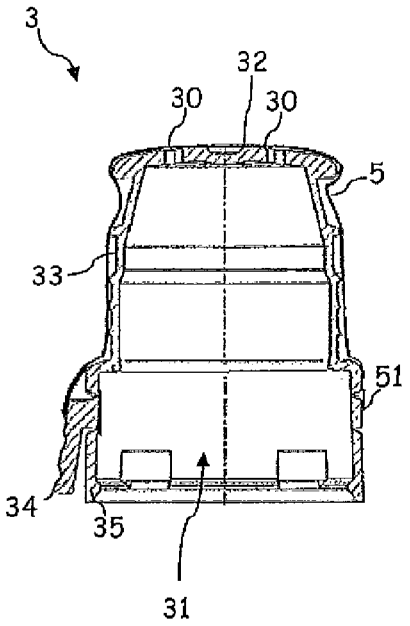
FIG. 3 shows a second exemplary embodiment of a protective cap for the dispenser according to FIG. 1.

FIGS. 2 and 3 show a first and a second exemplary embodiment of a protective cap 3 for the dispenser 2 according to FIG. 1. The protective caps 3 illustrated each have a plurality of ventilation openings 30 in order for an interior 31 to communicate with exterior surroundings. The protective caps 3 each comprise a cylindrical portion 32 and a cover portion 33 connected thereto. In the case of the protective cap 3 according to FIG. 2, the ventilation openings 30 are provided on the cylindrical portion 32. In the case of the protective cap 3 according to FIG. 3, the ventilation openings 30 are provided on the cover portion 33. The number of ventilation openings 30 can be selected appropriately in each case by a person skilled in the art. In preferred embodiments, the protective caps 3 according to FIGS. 2 and 3 each have four uniformly distributed ventilation openings 30. The protective caps 3 are each produced in the form of an injection molding and have a tamperproof seal 34, which is to be removed when the dispenser is used for the first time. In addition, latching elements 35 for latching to the dispenser 2 according to FIG. 1 are provided on an inner wall. The latching elements 35 here are configured such that they prevent the protective cap 3 from being removed, and/or the outlet subassembly 22 from being pulled off, from the container body 20 without the tamperproof seal 34 being removed. The protective cap 3, in addition, is configured such that it is possible for the protective cap 3 to be repeatedly removed from the dispenser 2 and be placed in position with clamping action thereon. For this purpose, the protective cap 3 is deformed to a slight extent when being placed in position, and therefore the elastic restoring forces of the protective cap 3 produced from plastics material generate a clamping action. In other configurations, latching elements are provided for this purpose.

According to the application, the protective cap 3 has arranged on it an irreversibly removable sealing element, which covers the ventilation openings and by means of which the ventilation openings 30 are closed in an air-tight and germ-proof manner prior to the dispenser being used for the first time. In other words, the sealing element prevents germs from being introduced into an interior 31 of the protective cap 3 via the ventilation openings 30 prior to the dispenser being used for the first time.

In the embodiments according to FIGS. 2 and 3, the sealing element is designed in the form of an air-tight and germ-proof film wrapper 5.

The film wrapper 5 according to FIG. 2 is configured in the form of a wraparound film label which is in the form of a sleeve and is provided on the cylindrical portion 32, in the region of the ventilation openings 30. The film wrapper 5 illustrated is welded to the protective cap 3 along the peripheral regions 50. The film wrapper 5 preferably has a lug or the like (not illustrated), which can be gripped for the purpose of removing the film wrapper 5.

The film wrapper 5 according to FIG. 3 is configured in the form of a closed wraparound film label and covers essentially the entire protective cap 3. The film wrapper 5 illustrated is connected to the tamperproof seal 34, for example it is welded or adhesively bonded thereto and can thus be removed therewith.

Figure 4:
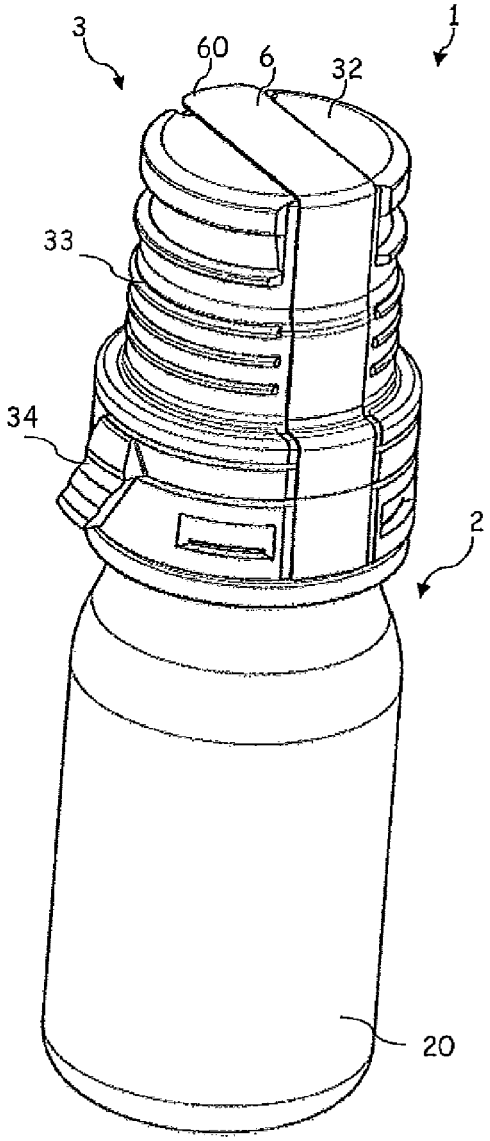
FIG. 4 shows an overall perspective illustration of a discharging device comprising a dispenser and a protective cap.
Figure 5:
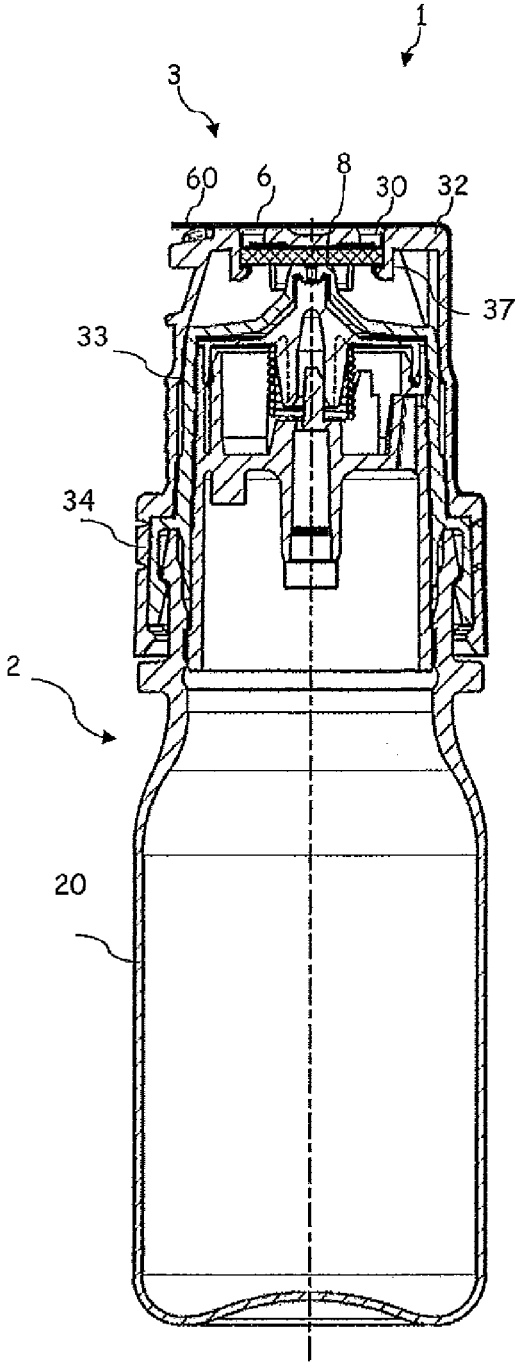
FIG. 5 shows a sectional illustration of the discharging device according to FIG. 4.
Figure 6:
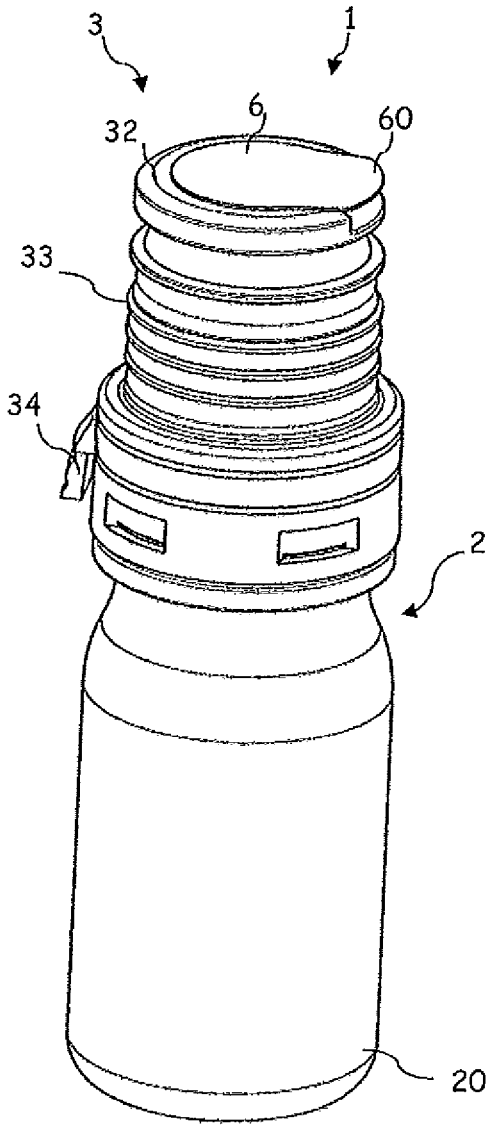
FIG. 6 shows an overall perspective illustration of an alternative configuration of a discharging device comprising a dispenser and a protective cap.
Figure 7:
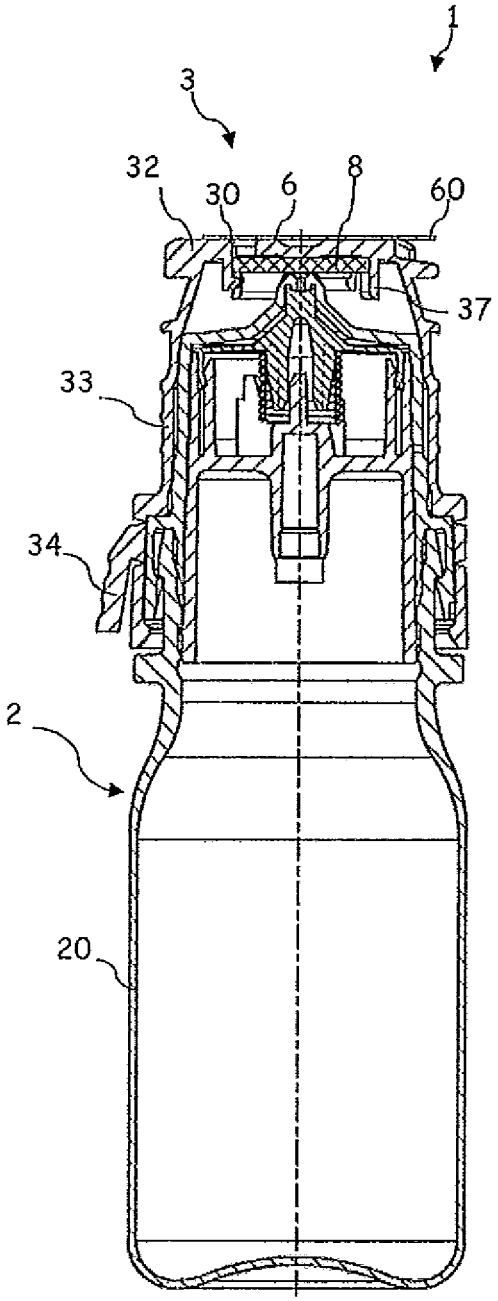
FIG. 7 shows a sectional illustration of the discharging device according to FIG. 6.

FIGS. 4 to 7 show two configurations of a discharging device 1 comprising a dispenser 2 according to FIG. 1 and a protective cap 3 in an overall perspective illustration (FIGS. 4 and 6) and a sectional illustration (FIGS. 5 and 7). For a description of the dispenser 2, you are referred to the text above. The protective cap 3 according to FIGS. 4 to 7 likewise corresponds essentially to the protective cap 3 according to FIGS. 2 and 3, and like reference signs are used for the same or similar components.

Figure 8:
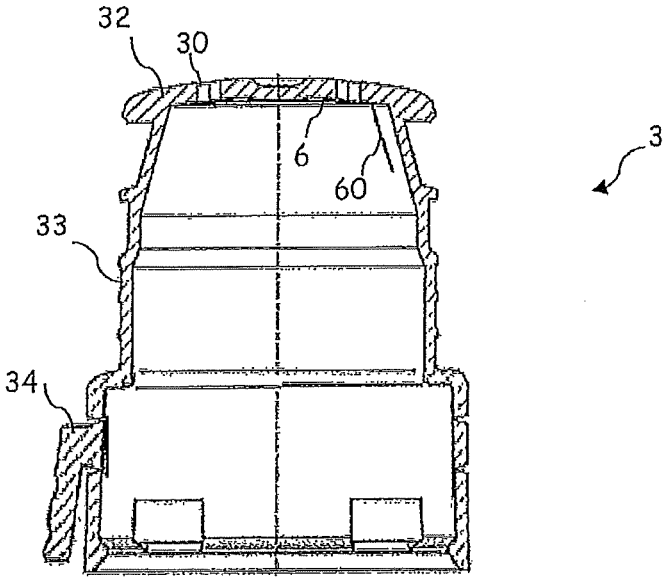
FIG. 8 shows a further exemplary embodiment of a protective cap for the dispenser according to FIG. 1.

FIG. 8 shows a protective cap 3 similar to FIG. 3 with ventilation openings 30 provided on the cover portion 33.

In the embodiments according to FIGS. 4 to 8, the sealing element is designed in the form of an air-tight and germ-proof adhesive label 6.

According to the configurations of FIGS. 4 to 7, an adhesive label 6 is arranged on an outer side of the protective cap 3, in the region of the ventilation openings 30. In the case of the configuration according to FIG. 8, the adhesive label 6 is arranged on an inner side of the protective cap 3, in the region of the ventilation openings 30.

In the case of the protective cap 3 according to FIGS. 4 and 5, the ventilation openings 30 are provided in the cover portion 33 and the strip-form adhesive label 6 extends from a region which surrounds the ventilation openings 30 in the cover portion 33, via a region running parallel to the longitudinal axis of the protective cap 3, to the tamperproof seal 34. The adhesive label 6 according to FIGS. 4 and 5 is thus of sufficiently large dimensions to allow for text with instructions for use or the like (not illustrated). The adhesive label 6 is also connected to the tamperproof seal 34, so that the adhesive label 6 can be released when the tamperproof seal is removed, and can therefore easily be pulled off by a user. In addition, the adhesive label 6 has a tear-open lug 60, by means of which a user can grip the adhesive label 6 in order to pull it off.

In the case of the protective cap 3 according to FIGS. 6 and 7, the ventilation openings 30 are likewise provided in the cover portion 33. However, the strip-form adhesive label 6, rather than extending to the tamperproof seal 34, extends only over a region which surrounds the ventilation openings 30 in the cover portion 33. A tear-open lug 60 is provided for the removal of the adhesive label 6. The cover portion 33 has an aperture 330, by way of which it is ensured that the tear-open lug 60 can be gripped straightforwardly.

It is also the case for the protective cap 3 according to FIG. 8 that the ventilation openings 30 are provided in the cover portion 33. The strip-form adhesive label 6 is fitted on an inner side of the cover portion 33 and has a tear-open lug 60 for removal purposes. On account of the complex handling, this ensures that a user, once he has pulled off the adhesive label 6, cannot fit the latter on the inner side again. In advantageous configurations, the adhesive label 6 is fitted such that, when the protective cap 3 is pulled off in order for the dispenser to be used for the first time, the adhesive label is at least released, and preferably pulled off altogether, automatically, i.e. without any additional measures being taken by the user.

Figure 9:
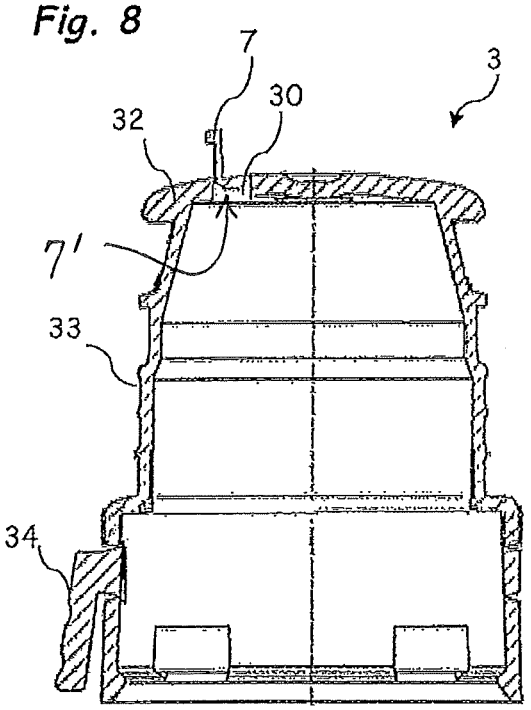
FIG. 9 shows yet another exemplary embodiment of a protective cap for the dispenser according to FIG. 1.

FIG. 9 shows a protective cap 3 similar to FIGS. 3 and 8 with ventilation openings 30 provided on the cover portion 33, wherein the sealing element is designed in the form of a pull-off lug 7 injection molded on the protective cap 3. The protective cap 3 and the pull-off lug 7 can be produced in the form of a joint component, in particular in the form of an injection molding. It is preferable here for predetermined breaking points in the form of material weakenings 7' or the like to be provided in a predetermined breaking region between the pull-off lug 7 and the protective cap 3. The pull-off lug 7 illustrated here has a projecting end which can be gripped by the user. In a different configuration, the pull-off lug 7 is coupled to the tamperproof seal 34, so that removal of the tamperproof seal causes the pull-off lug to be removed. This results in particularly straightforward handling for a user.

Once the sealing element 5, 6, 7 has been removed, the ventilation openings assist in rapid drying. In addition—as illustrated by way of example in FIGS. 4 to 7—in one configuration, an absorber element 8, which assists in rapid drying of the dispenser 2 as a result of the liquid being transported away, is provided on an inner side of the protective cap 3, in the region of the ventilation openings. The absorber element 8 has hydrophilic properties. The residual droplet is absorbed and distributed by the absorber element, and this therefore ensures rapid drying. In the exemplary embodiment illustrated, the absorber element 8 is arranged parallel to the cover portion 33, and covers the ventilation openings 30. In the exemplary embodiment illustrated, for the purpose of fastening the absorber element 8, latching arms 37 are provided on the protective cap 3, on an inner side of the cover portion 33. As can be seen in FIGS. 5 and 7, when the protective cap 3 is in the latched-on state, the absorber element 8 is in contact with a point at the top of the dispenser 2, assigned to the exit opening 24.

Once the sealing element 5, 6, 7 has been removed, a usually tolerable introduction of germs via the ventilation openings 30 is conceivable. In order to alleviate the problem of germs being introduced via said ventilation opening 30 in critical applications, the absorber element 8, in one configuration, is configured in the form of a microfiltration membrane. The microfiltration membrane has a cutoff of approximately 0.2 μm, and therefore bacteria of a size of approximately 0.2 to approximately 5 μm are reliably held back. As an alternative, or in addition, one configuration provides for the surfaces on which residual droplets collect downstream of the outlet valve 25 to be antibacterial.

The invention claimed is:

1. A discharge device for discharging pharmaceutical or cosmetic liquids, said discharge device comprising:

a dispenser, said dispenser comprising:

a liquid reservoir; and an exit opening through which liquid located in said liquid reservoir is discharged into a surrounding atmosphere;

a protective cap configured for repeated removal from, and repeated attachment to, said dispenser, said cap comprising:

a wall in which at least one ventilation opening is disposed, said ventilation opening permitting communication between an interior of said cap and the surrounding atmosphere; and an irreversibly removable sealing element disposed to cover said ventilation opening such that said ventilation opening is closed in an air-tight and germ-proof manner prior to said discharge device being used for the first time, said sealing element being configured as a pull-off lug injection molded on said cap.

2. The discharge device of claim 1, wherein said cap and said pull-off lug together comprise a unitary one-piece component.

3. The discharge device of claim 2, wherein said pull-off lug is attached to said cap by a material weakening disposed at a predetermined breaking point to permit complete removal and detachment of said pull-off lug from said cap.

4. The discharge device of claim 1, wherein said cap and said pull-off lug comprise a one-piece injection-molded component.

5. The discharge device of claim 1, wherein said pull-off lug is attached to said cap by a material weakening disposed at a predetermined breaking point to permit complete removal and detachment of said pull-off lug from said cap.

6. The discharge device of claim 1, wherein said protective cap comprises a cover portion and a cylindrical skirt portion connected thereto, said ventilation opening being disposed in one of said cover portion or said cylindrical skirt portion.

7. The discharge device of claim 1, further comprising a tamperproof seal, said pull-off lug being connected to said tamperproof seal such that said pull-off lug is released when said tamperproof seal is removed.

8. The discharge device of claim 1, further including an absorber element disposed adjacent an inner side of said protective cap in a region of said ventilation opening, said absorber element comprising filter properties.

9. The discharge device of claim 8, wherein said absorber element comprises a microfiltration membrane or an ultrafiltration membrane.

10. A discharge device for discharging pharmaceutical or cosmetic liquids, said discharge device comprising:

a dispenser, said dispenser including a container body defining therein a liquid reservoir, an outlet channel, and a droplet-forming exit opening through which liquid located in said liquid reservoir is discharged into a surrounding atmosphere, said dispenser further including a valve disposed to regulate flow of liquid through said outlet channel between said liquid reservoir and said exit opening; and a protective cap fastened to said container body and configured for repeated removal from, and repeated attachment to, said container body, said cap comprising a wall in which at least one ventilation opening is disposed and a pull-off lug formed integrally and in one-piece with said cap, said pull-off lug being attached to said cap by a material weakening disposed at a predetermined breaking point to permit complete removal and detachment of said pull-off lug from said cap, said pull-off lug being disposed to cover and seal said ventilation opening when said cap is fastened to said container body and before a first use of said discharge device such that said ventilation opening is closed in an air-tight and germ-proof manner, said ventilation opening permitting communication between said droplet-forming exit opening of said container body and the surrounding atmosphere after removal of said pull-off lug from said cap to permit evaporation of residual liquid located at said droplet forming exit opening.

* * * * *